US009905250B2

(12) United States Patent
Maouche

(10) Patent No.: US 9,905,250 B2
(45) Date of Patent: Feb. 27, 2018

(54) VOICE DETECTION METHOD

(71) Applicant: ADEUNIS R F, Crolles (FR)
(72) Inventor: Karim Maouche, Grenoble (FR)
(73) Assignee: ADEUNIS R F, Crolles (FR)

( * ) Notice: Subject to any disclaimer, the term of this patent is extended or adjusted under 35 U.S.C. 154(b) by 0 days.

(21) Appl. No.: 15/037,958

(22) PCT Filed: Nov. 27, 2014

(86) PCT No.: PCT/FR2014/053065
§ 371 (c)(1),
(2) Date: May 19, 2016

(87) PCT Pub. No.: WO2015/082807
PCT Pub. Date: Jun. 11, 2015

(65) Prior Publication Data

US 2016/0284364 A1 Sep. 29, 2016

(30) Foreign Application Priority Data

Dec. 2, 2013 (FR) ..... 13 61922

(51) Int. Cl.
*G10L 25/84* (2013.01)
*G10L 25/78* (2013.01)

(52) U.S. Cl.
CPC ..... *G10L 25/84* (2013.01); *G10L 2025/783* (2013.01); *G10L 2025/786* (2013.01)

(58) Field of Classification Search
CPC ..... G10L 25/84; G10L 2025/783; G10L 2025/786
(Continued)

(56) References Cited

U.S. PATENT DOCUMENTS 8,812,313 B2 * 8/2014 Arakawa ..... G10L 25/78 379/390.03
2009/0076814 A1 * 3/2009 Lee ..... G10L 25/78 704/233
(Continued)

FOREIGN PATENT DOCUMENTS

EP 1 843 326 A1 10/2007
FR 2 825 505 A1 12/2002
(Continued)

OTHER PUBLICATIONS

Hae Young Kim et al: "Pitch Detection With Average Magnitude Difference Function Using Adaptive Threshold Algorithm for Estimating Shimmer and Jitter", Engineering in Med: and Biology Society, 1998. Proceedings ( 20th Annual International Conference of IEEE, IEEE—Piscataway, NJ, US, vol. 6, Oct. 1998 (Oct. 29, 1998), pp. 3162-3163.*
Feb. 23, 2015 Search Report issued in International Patent Application No. PCT/FR2014/053065.
Feb. 23, 2015 Written Opinion issued in Internation Patent Application No. PCT/FR2014/053065.
(Continued)

*Primary Examiner* — Paras D Shah
*Assistant Examiner* — Rodrigo Chavez
(74) *Attorney, Agent, or Firm* — Oliff PLC

(57) ABSTRACT

A voice detection method which makes it possible to detect the presence of voice signals in an noisy acoustic signal x(t) from a microphone, including the following consecutive steps: calculating a detection function FD(τ) based on calculating a difference function D(τ) varying in accordance with the shift τ on an integration window with length W starting at the time t0, with: a step of adapting the threshold in said current interval, in accordance with values calculated from the acoustic signal x(t) established in said current interval; searching for the minimum of the detection function FD(τ) and comparing the minimum with a threshold, for (τ) varying in a predetermined time interval referred to as current interval so as to detect the possible presence of a fundamental frequency $F_0$ that is characteristic of a voice signal in said current interval.

22 Claims, 3 Drawing Sheets

(58) Field of Classification Search
USPC ..... 704/233
See application file for complete search history.

(56) References Cited

U.S. PATENT DOCUMENTS

| | | | | |
|---|---|---|---|---|
| 2013/0246062 | A1* | 9/2013 | Avargel | G10L 25/90 704/233 |
| 2016/0284364 | A1* | 9/2016 | Maouche | G10L 25/84 |

FOREIGN PATENT DOCUMENTS

| | | | |
|---|---|---|---|
| FR | 2 988 894 | A1 | 10/2013 |
| WO | 2010/149864 | A1 | 12/2010 |
| WO | 2010/149875 | A1 | 12/2010 |

OTHER PUBLICATIONS

Kim, Hae Young et al., "Pitch Detection With Average Magnitude Difference Function Using Adaptive Threshold Algorithm for Estimating Shimmer and Jitter", Proceedings of the 20th Annual International Conference of the IEEE Engineering in Medicine and Biology Society, vol. 20, No. 6, 1998, pp. 3162-3165.
Berisha, Visar et al., "Real-Time Implementation of a Distributed Voice Activity Detector", Fourth IEEE Workshop on Sensor Array and Multichannel Processing, 2006, pp. 659-662.
de Cheveigné, Alain et al., "YIN, a fundamental frequency estimator for speech and music", Journal of the Acoustical Society of America, Apr. 2002, vol. 111, No. 4, pp. 1917-1930.

* cited by examiner

VOICE DETECTION METHOD

The present invention relates to a voice detection method allowing to detect the presence of speech signals in a noisy acoustic signal coming from a microphone.

It relates more particularly to a voice detection method used in a mono-sensor wireless audio communication system.

The invention lies in the specific field of the voice activity detection, generally called «VAD» for Voice Activity Detection, which consists in detecting the speech, in other words speech signals, in an acoustic signal coming from a microphone.

The invention finds a preferred, but not limiting, application with a multi-user wireless audio communication system of the type time-division multiplexing or full-duplex communication system, among several autonomous communication terminals, that is to say without connection to a transmission base or to a network, and easy to use, that is to say without the intervention of a technician to establish the communication.

Such a communication system, mainly known from the documents WO10149864 A1, WO10149875 A1 and EP1843326 A1, is conventionally used in a noisy or even very noisy environment, for example in the marine environment, as part of a show or a sporting event indoors or outdoors, on a construction site, etc.

The voice activity detection generally consists in delimiting by means of quantifiable criteria, the beginning and end of words and/or of sentences in a noisy acoustic signal, in other words in a given audio stream. Such detection is applicable in fields such as the speech coding, the noise reduction or even the speech recognition.

The implementation of a voice detection method in the processing chain of an audio communication system allows in particular not to transmit acoustic or audio signal during the periods of silence. Therefore, the surrounding noise will not be transmitted during these periods, in order to improve the audio rendering of the communication or to reduce the transmission rate. For example, in the context of speech coding, it is known to use the voice activity detection to fully encode the audio signal as when the «VAD» method indicates activity. Therefore, when there is no speech and it is a period of silence, the coding rate decreases significantly, which, on average, over the entire signal, allows reaching lower rates.

Thus, there are many methods for detecting the voice activity but the latter have poor performance or do not work at all in the context of a noisy or even very noisy environment, such as an environment of sport match (outdoors or indoors) with referees who must communicate in an audio and wireless manner. Indeed, the known voice activity detection methods give bad results when the speech signal is affected by noise.

Among the known voice activity detection methods, some implement a detection of the fundamental frequency characteristic of a speech signal, as disclosed in particular in the document FR 2 988 894. In the case of a speech signal, called voiced signal or sound, the signal has indeed a frequency called fundamental frequency, generally called «pitch», which corresponds to the frequency of vibration of the vocal cords of the person who speaks, which generally extends between 70 and 400 Hertz. The evolution of this fundamental frequency determines the melody of the speech and its extent depends on the speaker, on his habits but also on his physical and mental state.

Thus, in order to carry out the detection of a speech signal, it is known to assume that such a speech signal is quasi-periodic and that, therefore, a correlation or a difference with the signal itself but shifted will have maxima or minima in the vicinity of the fundamental frequency and its multiples.

The document «YIN, a fundamental frequency estimator for speech and music», by Alain De Cheveigne and Hideki Kawahara, Journal of the Acoustical Society of America, Vol. 111, No. 4, pp. 1917-1930, April 2002, provides and develops a method based on the difference between the signal and the same temporally shifted signal.

Several methods described hereinafter are based on the detection of the fundamental frequency of the speech signal or pitch in an noisy acoustic signal x(t).

A first method for detecting the fundamental frequency implements the research for the maximum of the auto-correlation function R(τ) defined by the following relationship:

$$R(\tau) = \frac{1}{N}\sum_{n=0}^{N-1-\tau} x(n)x(n+\tau),\ 0 \le \tau \le \max(\tau).$$

This first method using the auto-correlation function is however not satisfactory since there is a relatively significant noise. Furthermore, the auto-correlation function suffers from the presence of maxima which do not correspond to the fundamental frequency or to its multiples, but to sub-multiples thereof.

A second method for detecting the fundamental frequency implements the research of the minimum of the difference function D(τ) defined by the following relationship:

$$D(\tau) = \frac{1}{N}\sum_{n=0}^{N-1-\tau} |x(n) - x(n+\tau)|,\ 0 \le \tau \le \max(\tau),$$

where | | is the absolute value operator, this difference function being minimum in the vicinity of the fundamental frequency and its multiples, then the comparison of this minimum with a threshold in order to deduce therefrom the decision of presence or not of voice.

Relative to the auto-correlation function R(τ), the difference function D(τ) has the advantage of providing a lower calculation load, thus making this second method more interesting for applications in real time. However, this second method is not entirely satisfactory either since there is noise.

A third method for detecting the fundamental frequency implements the calculation, considering a processing window of length H, where H<N, of the square difference function $d_t(\tau)$ defined by the relationship:

$$d_t(\tau)=\Sigma_{j=t}^{t+H-1}(x_j-x_{j+\tau})^2,$$

Then it continues with the research for the minimum of the square difference function $d_t(\tau)$, this square difference function being minimum in the vicinity of the fundamental frequency and its multiples, and finally the comparison of this minimum with a threshold in order to deduce therefrom the decision of presence or not of voice.

A known improvement of this third method consists in normalizing the square difference function $d_t(\tau)$ by calculating a normalized square difference function $d'_t(\tau)$ satisfying the following relationship:

$$d'_t(\tau)=\begin{cases}1, \text{ if } \tau=0\\ \dfrac{d_t(\tau)}{\left(\frac{1}{\tau}\right)\sum_{j=1}^{\tau} d_t(j)} \text{ otherwise}\end{cases}$$

Although having a better noise immunity and giving, in this context, better detection results, this third method has limits in terms of voice detection, in particular in areas of noise at low SNR (Signal by Noise Ratio) characteristic of a very noisy environment.

The state of the art may also be illustrated by the teaching of the patent application FR 2 825 505 which implements the third method of detection of the aforementioned fundamental frequency, for the extraction of this fundamental frequency. In this patent application, the normalized square difference function $d'_t(\tau)$ can be compared to a threshold in order to determine this fundamental frequency—this threshold may be fixed or vary in accordance with the time-shift $\tau$—and this method has the aforementioned drawbacks associated with this third method.

It is also known to use a voice detection method implementing the detection of a fundamental frequency, of the document «Pitch detection with average magnitude difference function using adaptive threshold algorithm for estimating shimmer and jitter», by Hae Young Kim et al., Engineering In Medicine And Biology Society, 1998, Proceedings of the 20$^{th}$ Annual International Conference of the IEEE, vol. 6, Oct. 29, 1998, pages 3162-6164, XP010320717. In this document, it is described a method consisting in searching for the minimum of an auto-correlation function, by implementing a comparison with an adaptive threshold which is function of minimum and maximum values of the signal in the current frame. This adaptation of the threshold is however very limited. Indeed, in a situation of an audio signal with different values of signal-to-noise ratio but with the same signal magnitude, the threshold would be the same for all situations without the latter changing depending on the noise level, which may thus cause cuts at the beginning of sentence or even non-detections of the voice, when the signal to be detected is a voice, in particular in a context where the noise is a noise of diffuse spectators so that it does not look, at all, like a speech signal.

The present invention aims to provide a voice detection method which provides a detection of speech signals contained in a noisy acoustic signal, in particular in noisy or even very noisy environments.

It provides more particularly a voice detection method which is very suitable for the communication (mainly between referees) within a stadium where the noise is relatively very strong in level and is highly non-stationary, with steps of detection which avoid especially bad or false detections (generally called «tonches») due to the songs of spectators, wind instruments, drums, music and whistles.

To this end, it provides a voice detection method allowing to detect the presence of speech signals in an noisy acoustic signal x(t) coming from a microphone, including the following successive steps:

a preliminary sampling step comprising a cutting of the acoustic signal x(t) into a discrete acoustic signal $\{x_i\}$ composed of a sequence of vectors associated with time frames i of length N, N corresponding to the number of sampling points, where each vector reflects the acoustic content of the associated frame i and is composed of N samples $x_{(i-1)N+1}$, $x_{(i-1)N+2}$, . . . , $x_{iN-1}$, $x_{iN}$, i being a positive integer;

a step of calculating a detection function FD($\tau$) based on the calculation of a difference function D($\tau$) varying in accordance with a shift $\tau$ on an integration window of length W starting at the time t0, with:

$$D(\tau)=\Sigma_{n=t0}^{t0+w-1}|x(n)-x(n+\tau)| \text{ where } 0\leq\tau\leq\max(\tau);$$

wherein this step of calculating a detection function $FD_i(\tau)$ consists in calculating a discrete detection function $FD_i(\tau)$ associated with the frames i;

a step of adapting a threshold in said current interval, in accordance with values calculated from the acoustic signal x(t) established in said current interval, and in particular maximum values of said acoustic signal x(t), wherein this step of adapting a threshold consists in, for each frame i, adapting a threshold $\Omega_i$ specific to the frame i depending on reference values calculated from the values of the samples of the discrete acoustic signal $\{x_i\}$ in said frame i;

a step of searching for a minimum of the detection function FD($\tau$) and comparing this minimum with a threshold, for $\tau$ varying in a determined time interval called current interval in order to detect the presence or not of a fundamental frequency $F_0$ characteristic of a speech signal within said current interval;

where this step of searching for a minimum of the detection function FD($\tau$) and the comparison of this minimum with a threshold are carried out by searching, on each frame i, for a minimum rr(i) of the discrete detection function $FD_i(\tau)$ and by comparing this minimum rr(i) with a threshold $\Omega_i$ specific to the frame i;

and wherein a step of adapting the thresholds $\Omega_i$ for each frame i includes the following steps:

a)—subdividing the frame i comprising N sampling points into T sub-frames of length L, where N is a multiple of T so that the length L=N/T is an integer, and so that the samples of the discrete acoustic signal $\{x_i\}$ in a sub-frame of index j of the frame i comprise the following L samples:

$$x_{(i-1)N+(j-1)L+1}, x_{(i-1)N+(j-1)L+2}, \ldots, x_{(i-1)N+jL},$$

j being a positive integer comprised between 1 and T;

b)—calculating a maximum values $m_{i,j}$ of the discrete acoustic signal $\{x_i\}$ in each sub-frame of index j of the frame i, with:

$$m_{i,j}=\max\{x_{(i-1)N+(j-1)L+1}, x_{(i-1)N+(j-1)L+2}, \ldots, x_{(i-1)N+jL}\};$$

c)—calculating at least one reference value $Ref_{i,j}$, $MRef_{i,j}$ specific to the sub-frame j of the frame i, the or each reference value $Ref_{i,j}$, $MRef_{i,j}$ per sub-frame j being calculated from the maximum value $m_{i,j}$ in the sub-frame j of the frame i;

d)—establishing the value of the threshold $\Omega_i$ specific to the frame i depending on all the reference values $Ref_{i,j}$, $MRef_{i,j}$ calculated in the sub-frames j of the frame i.

Thus, this method is based on the principle of an adaptive threshold, which will be relatively low during the periods of noise or silence and relatively high during the periods of speech. Thus, the false detections will be minimized and the speech will be detected properly with a minimum of cuts at the beginning and the end of words. With the method according to the invention, the maximum values $m_{i,j}$ established in the sub-frames j are considered in order to make the decision (voice or absence of voice) on the entire frame i.

According to a first possibility, the detection function FD(τ) corresponds to the difference function D(τ).

According to a second possibility, the detection function FD(τ) corresponds to the normalized difference function DN(τ) calculated from the difference function D(τ) as follows:

$$DN(\tau) = 1 \text{ if } \tau = 0,$$

$$DN(\tau) = \frac{D(\tau)}{(1/\tau)\sum_{j=1}^{\tau} D(j)} \text{ if } \tau \neq 0;$$

where the calculation of the normalized difference function DN(τ) consists in a calculation of a discrete normalized difference function $DN_i(\tau)$ associated with the frames i, where:

$$DN_i(\tau) = 1 \text{ if } \tau = 0,$$

$$DN_i(\tau) = \frac{D_i(\tau)}{(1/\tau)\sum_{j=1}^{\tau} D_i(j)} \text{ if } \tau \neq 0;$$

In a particular embodiment, the discrete difference function $D_i(\tau)$ relative to the frame i is calculated as follows:

subdividing the field i into K sub-frames of length H, with for example $$K = \left\lfloor \frac{N - \max(\tau)}{H} \right\rfloor$$

where ⌊ ⌋ represents the operator of rounding to integer part, so that the samples of the discrete acoustic signal $\{x_i\}$ in a sub-frame of index p of the frame i comprise the H samples:

$$x_{(i-1)N+(p-1)H+1}, x_{(i-1)N+(p-1)H+2}, \ldots, x_{(i-1)N+pH},$$

p being a positive integer comprised between 1 and K;

for each sub-frame of index p, we calculate the following difference function ddp(τ):

$$dd_p(\tau)=\Sigma_{j=(i-1)N+(p-1)H+1}^{(i-1)N+pH}|x_j-x_{j+\tau}|,$$

calculating the discrete difference function $D_i(\tau)$ relative to the frame i as the sum of the difference functions $dd_p(\tau)$ of the sub-frames of index p of the frame i, namely:

$$D_i(\tau)=\Sigma_{p=1}^{K} dd_p(\tau).$$

According to one characteristic, during step c), the following sub-steps are carried out on each frame i:

c1) calculating smoothed envelopes of the maxima $\overline{m}_{i,j}$ in each sub-frame of index j of the frame i, with:

$$\overline{m}_{i,j}=\lambda\overline{m}_{i,j-1}+(1-\lambda)m_{i,j},$$

where λ is a predefined coefficient comprised between 0 and 1;

c2) calculating variation signals $\Delta_{i,j}$ in each sub-frame of index j of the frame i, with:

$$\Delta_{i,j}=m_{i,j}-\overline{m}_{i,j}=\lambda(m_{i,j}-\overline{m}_{i,j-1});$$

and where at least one reference value called main reference value $Ref_{i,j}$ per sub-frame j is calculated from the variation $\Delta_{i,j}$ signal in the sub-frame j of the frame i.

Thus, the variation signals $\Delta_{i,j}$ of the smoothed envelopes established in the sub-frames j are considered in order to make the decision (voice or absence of voice) on the entire frame i, making the detection of the speech (or voice) more reliable.

According to another characteristic, during step c) and subsequently to sub-step c2), the following sub-steps are carried out on each frame i:

c3) calculating variation maxima $s_{i,j}$ in each sub-frame of index j of the frame i, where $s_{i,j}$ corresponds to the maximum of the variation signal $\Delta_{i,j}$ calculated on a sliding window of length Lm prior to said sub-frame j, said length Lm is variable depending on whether the sub-frame j of the frame i corresponds to a period of silence or presence of speech;

c4) calculating the variation differences $\delta_{i,j}$ in each sub-frame of index j of the frame i, with:

$$\delta_{i,j}=\Delta_{i,j}-s_{i,j};$$

and where, for each sub-frame j of the frame i, two main reference values $Ref_{i,j}$ are calculated respectively from the variation signal $\Delta_{i,j}$ and the variation difference $\delta_{i,j}$.

Thus, the variation signals $\Delta_{i,j}$ and the variation differences $\delta_{i,j}$ established in the sub-frames j are jointly considered in order to select the value of the adaptive threshold $\Omega_i$ and thus to make the decision (voice or absence of voice) on the entire frame i, reinforcing the detection of the speech. In other words, the pair $(\Delta_{i,j}; \delta_{i,j})$ is considered in order to determine the value of the adaptive threshold $\Omega_i$.

Advantageously, during step c) and as a result of the sub-step c4), there is performed a sub-step c5) of calculating normalized variation signals $\Delta'_{i,j}$ and normalized variation differences $\delta'_{i,j}$ in each sub-frame of index j of the frame i, as follows:

$$\Delta'_{i,j} = \frac{\Delta_{i,j}}{\overline{m}_{i,j}} = \frac{m_{i,j} - \overline{m}_{i,j}}{\overline{m}_{i,j}};$$

$$\delta'_{i,j} = \frac{\delta_{i,j}}{\overline{m}_{i,j}} = \frac{m_{i,j} - \overline{m}_{i,j} - s_{i,j}}{\overline{m}_{i,j}};$$

and where, for each sub-frame j of a frame i, the normalized variation signal $\Delta'_{i,j}$ and the normalized variation difference $\delta'_{i,j}$, constitute each a main reference value $Ref_{i,j}$ so that, during step d), the value of the threshold $\Omega_i$ specific to the frame i is established depending on the pair $(\Delta'_{i,j}, \delta'_{i,j})$ of the normalized variation signals $\Delta'_{i,j}$ and the normalized variation differences $\delta'_{i,j}$ in the sub-frames j of the frame i.

In this way, it is possible to process the variation of the threshold $\Omega_i$ independently from the levels of the signals $\Delta_{i,j}$ and $\delta_{i,j}$ by normalizing them with the calculation of the normalized signals $\Delta'_{i,j}$ and $\delta'_{i,j}$. Thus, the thresholds $\Omega_i$, selected from these normalized signals $\Delta'_{i,j}$ and $\delta'_{i,j}$ will be independent of the level of the discrete acoustic signal $\{x_i\}$. In other words, the pair $(\Delta'_{i,j}; \delta'_{i,j})$ is studied in order to determine the value of the adaptive threshold $\Omega_i$.

Advantageously, during step d), the value of the threshold $\Omega_i$ specific to the frame i is established by partitioning the space defined by the value of the pair $(\Delta'_{i,j}; \delta'_{i,j})$, and by examining the value of the pair $(\Delta'_{i,j}; \delta'_{i,j})$ on one or more (for example between one and three) successive sub-frame(s) according to the value area of the pair $(\Delta'_{i,j}; \delta'_{i,j})$.

Thus, the calculation procedure of the threshold $\Omega_i$ is based on an experimental partition of the space defined by the value of the pair $(\Delta'_{i,j}; \delta'_{i,j})$. A decision mechanism, which scrutinizes the value of the pair $(\Delta'_{i,j}; \delta'_{i,j})$ on one, two or more successive sub-frame(s) according to the value area of the pair, is added thereto. The conditions of positioning tests of the value of the pair ($\Delta'_{i,j}$; $\delta'_{i,j}$) depend mostly on the speech detection during the preceding frame and the polling mechanism on one, two or more successive sub-frame(s) also uses an experimental partitioning.

According to one characteristic, during the sub-step c3), the length Lm of the sliding window meets the following equations:

Lm=L0 if the sub-frame j of the frame i corresponds to a period of silence;

Lm=L1 if the sub-frame j of the frame i corresponds to a period of presence of speech;

with L1<L0, in particular with L1=k1.L and L0=k0.L, L being the length of the sub-frame of index j and k0, k1 being positive integers.

According to another characteristic, during the sub-step c3), for each calculation of the variation maximum in the sub-frame j of the frame i, the sliding window of length Lm is delayed by Mm frames of length N vis-à-vis said sub-frame j.

According to another characteristic, there is provided the following improvements:

during the sub-step c3), also calculating normalized variation maxima $s'_{i,j}$ in each sub-frame of index j of the frame i, wherein $s'_{i,j}$, corresponds to the maximum of the normalized variation signal $\Delta'_{i,j}$ calculated on a sliding window of length Lm prior to said sub-frame j, where:

$$s'_{i,j} = \frac{s_{i,j}}{\bar{m}_{i,j}};$$

and wherein each normalized variation maximum $s'_{i,j}$ is calculated according to a minimization method comprising the following iterative steps:

calculating $s'_{i,j}=\max\{s'_{i,j-1}; \Delta'_{i-mM,j}\}$ and $\tilde{s}'_{i,j}=\max\{s'_{i,j-1}; \Delta'_{i-Mm,j}\}$ if rem(i, Lm)=0, where rem is the remainder operator of the integer division of two integers, then:

$$s'_{i,j}=\max\{\tilde{s}'_{i,j-1};\Delta'_{i-Mm,j}\},$$

$$\tilde{s}'_{i,j}=\Delta'_{i-Mm,j}$$

with $s'_{0,1}=0$ and $\tilde{s}'_{0,1}=0$; and during step c4), calculating the normalized variation differences $\delta'_{i,j}$ in each sub-frame of index j of the frame i, as follows:

$$\delta'_{i,j}=\Delta'_{i,j}-s'_{i,j}.$$

Advantageously, during step c), there is carried out a sub-step c6) wherein maxima of the maximum $q_{i,j}$ are calculated in each sub-frame of index j of the frame i, wherein $q_{i,j}$ corresponds to the maximum of the maximum value $m_{i,j}$ calculated on a sliding window of fixed length Lq prior to said sub-frame j, where the sliding window of length Lq is delayed by Mq frames of length N vis-à-vis said sub-frame j, and where another reference value called secondary reference value $MRef_{i,j}$ per sub-frame j corresponds to said maximum of the maximum $q_{i,j}$ in the sub-frame j of the frame i.

Thus, in order to further avoid the false detections, it is advantageous to also take into account this signal $q_{i,j}$ (secondary reference value $MRef_{i,j}=q_{i,j}$) which is calculated in a similar way to the calculation of the aforementioned signal $s_{i,j}$, but which operates on the maximum values $m_{i,j}$ instead of operating on the variation signals $\Delta_{i,j}$ or the normalized variation signals $\Delta'_{i,j}$.

In a particular embodiment, during step d), the threshold $\Omega_i$ specific to the frame i is cut into several sub-thresholds $\Omega_{i,j}$ specific to each sub-frame j of the frame i, and the value of each sub-threshold $\Omega_{i,j}$ is at least established depending on the reference value(s) $Ref_{i,j}$, $MRef_{i,j}$ calculated in the sub-frame j of the corresponding frame i.

Thus, we have $\Omega_i=\{\Omega_{i,1}; \Omega_{i,2}; \ldots ; \Omega_{i,T}\}$, reflecting the cutting of the threshold $\Omega_i$ into several sub-thresholds $\Omega_{i,j}$ specific to the sub-frames j, providing an additional fineness in establishing the adaptive threshold $\Omega_i$.

Advantageously, during step d), the value of each threshold $\Omega_{i,j}$ specific to the sub-frame j of the frame i is established by comparing the values of the pair ($\Delta'_{i,j}$, $\delta'_{i,j}$) with several pairs of fixed thresholds, the value of each threshold $\Omega_{i,j}$ being selected from several fixed values depending on the comparisons of the pair ($\Delta'_{i,j}$, $\delta'_{i,j}$) with said pairs of fixed thresholds.

These pairs of fixed thresholds are, for example, experimentally determined by a distribution of the space of the values ($\Delta'_{i,j}$, $\delta'_{i,j}$) into decision areas.

Complementarily, the value of each threshold $\Omega_{i,j}$ specific to the sub-frame j of the frame i is also established by carrying out a comparison of the pair ($\Delta'_{i,j}$, $\delta'_{i,j}$) on one or more successive sub-frame(s) according the initial area of the pair ($\Delta'_{i,j}$, $\delta'_{i,j}$).

The conditions of positioning tests of the value of the pair ($\Delta'_{i,j}$, $\delta'_{i,j}$) depend on the speech detection during the preceding frame and the comparison mechanism on one or more successive sub-frame(s) also uses an experimental partitioning.

Of course, it is also conceivable to establish the value of each threshold $\Omega_{i,j}$ specific to the sub-frame j of the frame i by comparing:

the values of the pair ($\Delta'_{i,j}$, $\delta'_{i,j}$) (the main reference values $Ref_{i,j}$) with several pairs of fixed thresholds;

the values of $q_{i,j}$ (the secondary reference value $MRef_{i,j}$) with several other fixed thresholds.

Thus, the decision mechanism based on comparing the pair ($\Delta'_{i,j}$, $\delta'_{i,j}$) with pairs of fixed thresholds, is completed by another decision mechanism based on the comparison of $q_{i,j}$ with other fixed thresholds.

Advantageously, during step d), there is carried out a procedure called decision procedure comprising the following sub-steps, for each frame i:

for each sub-frame j of the frame i establishing an index of decision $DEC_i(j)$ which holds either a state «1» of detection of a speech signal or a state «0» of non-detection of a speech signal;

establishing a temporary decision VAD(i) based on the comparison of the indices of decision $DEC_i(j)$ with logical operators «OR», so that the temporary decision VAD(i) holds a state «1» of detection of a speech signal if at least one of said indices of decision $DEC_i(j)$ holds this state «1» of detection of a speech signal.

Thus, to avoid late detections (hyphenation in early detection), the final decision (voice or absence of voice) is taken as a result of this decision procedure by relying on the temporary decision VAD(i) which is itself taken on the entire frame i, by implementing a logical operator «OR» on the decisions taken in the sub-frames j, and preferably in successive sub-frames j on a short and finished horizon from the beginning of the frame i.

During this decision procedure, the following sub-steps may be carried out for each frame i:

storing a threshold maximum value Lastmax which corresponds to the variable value of a comparison threshold for the magnitude of the discrete acoustic signal $\{x_i\}$ below which it is considered that the acoustic signal does not comprise speech signal, this variable value being determined during the last frame of index k which precedes said frame i and in which the temporary decision VAD(k) held a state «1» of detection of a speech signal;

storing an average maximum value $A_{i,j}$ which corresponds to the average maximum value of the discrete acoustic signal $\{x_i\}$ in the sub-frame j of the frame i calculated as follows:

$$A_{i,j}=\theta A_{i,j-1}+(1-\theta)a_{i,j}$$

where $a_{i,j}$ corresponds to the maximum of the discrete acoustic signal $\{x_i\}$ contained in a frame k formed by the sub-frame j of the frame i and by at least one or more successive sub-frame(s) which precede said sub-frame j; and $\theta$ is a predefined coefficient comprised between 0 and 1 with $\theta<\lambda$ establishing the value of each sub-threshold $\Omega_{i,j}$ depending on the comparison between said threshold maximum value Lastmax and average maximum values $A_{i,j}$ and $A_{i,j-1}$ considered on two successive sub-frames j and j−1.

In many cases, the false detections arrive with a magnitude lower than that of the speech signal (the microphone being located near the mouth of the person who communicates). Thus, this decision procedure aims to further eliminate bad detections by storing the threshold maximum value Lastmax of the speech signal updated in the last period of activation and the average maximum values $A_{i,j}$ and $A_{i,j-1}$ which correspond to the average maximum value of the discrete acoustic signal $\{x_i\}$ in the sub-frames j and j−1 of the frame i. Taking into account these values (Lastmax, $A_{i,j}$ and $A_{i,j-1}$), a condition at the establishment of the adaptive threshold $\Omega_i$ is added.

It is important that the value of $\theta$ is selected as being lower than the coefficient $\lambda$ in order to slow the fluctuations of $A_{i,j}$.

During the aforementioned decision procedure, the threshold maximum value Lastmax is updated whenever the method has considered that a sub-frame p of a frame k contains a speech signal, by implementing the following procedure:

detecting a speech signal in the sub-frame p of the frame k follows a period of absence of speech, and in this case Lastmax takes the updated value $[\alpha(A_{k,p}+\text{LastMax})]$, where $\alpha$ is a predefined coefficient comprised between 0 and 1, and for example comprised between 0.2 and 0.7;

detecting a speech signal in the sub-frame p of the frame k follows a period of presence of speech, and in this case Lastmax takes the updated value $A_{k,p}$ if $A_{k,p}>\text{Lastmax}$.

The update of the value Lastmax is thus performed only during the activation periods of the method (in other words, the voice detection periods). In a speech detection situation, the value Lastmax will be worth $A_{k,p}$ when we will have $A_{k,p}>\text{LastMax}$. However, it is important that this update is performed as follows upon the activation of the first sub-frame p which follows an area of silence: the value Lastmax will be worth $[\alpha(A_{k,p}+\text{LastMax})]$.

This updating mechanism of the threshold maximum value Lastmax allows the method to detect the voice of the user even if the latter has reduced the intensity of his voice (in other words speaks quieter) compared to the last time where the method has detected that he had spoken.

In other words, in order to further improve the removal of the false detections, a fine processing is carried out in which the threshold maximum value Lastmax is variable and compared with the average maximum values $A_{i,j}$ and $A_{i,j-1}$ of the discreet acoustic signal.

Indeed, distant voices could be collected with the method, because such voices have fundamental frequencies likely to be detected such as the voice of the user. In order to ensure that the distant voices, which may be annoying in many cases of use, are not taken into account by the method, there is considered a processing during which the average maximum value of the signal (on two successive frames), in this case $A_{i,j}$ and $A_{i,j-1}$, is compared with Lastmax which constitutes a variable threshold according to the magnitude of the voice of the user measured in the last activation. Thus, the value of the threshold $\Omega_i$ is set at a very low minimum value, when the signal will be below the threshold.

This condition to establish the value of the threshold $\Omega_i$ depending on the threshold maximum value Lastmax is advantageously based on a comparison between:

the threshold maximum value Lastmax; and the values $[Kp.A_{i,j}]$ and $[Kp.A_{i,j-1}]$, where Kp is a fixed weighting coefficient comprised between 1 and 2.

In this way, the threshold maximum value Lastmax is compared with the average maximum values of the discrete acoustic signal $\{x_i\}$ in the sub-frames j and j−1 ($A_{i,j}$ and $A_{i,j-1}$) weighted with an weighting coefficient Kp comprised between 1 and 2, in order to reinforce the detection. This comparison is made only when the preceding frame has not resulted in voice detection.

Advantageously, the method further includes a phase called blocking phase comprising a step of switching from a state of non-detection of a speech signal to a state of detection a speech signal after having detected the presence of a speech signal on $N_p$ successive time frames i.

Thus, the method implements a hangover type step configured such that the transition from a situation without voice to a situation with presence of voice is only done after $N_p$ successive frames with presence of voice.

Similarly, the method further includes a phase called blocking phase comprising a switching step from a state of detection of a speech signal to a state of non-detection of a speech signal after having detected no presence of a speech signal on $N_A$ successive time frames i.

Thus, the method implements a hangover type step configured so that the transition from a situation with presence of voice to a situation without voice is only made after $N_A$ successive frames without voice.

Without these switching steps, the method may occasionally cut the acoustic signal during the sentences or even in the middle of spoken words. In order to overcome this, these switching steps implement a blocking or hangover step on a given series of frames.

According to one possibility of the invention, the method comprises a step of interrupting the blocking phase in the decision areas occurring at the end of words and in a non-noisy situation, said decision areas being detected by analyzing the minimum rr(i) of the discrete detection function $FD_i(\tau)$.

Thus, the blocking phase is interrupted at the end of a sentence or word during a particular detection in the decision space. This interruption occurs only in a non-noisy or little noisy situation. As such, the method provides for insulating a particular decision area which occurs only at the end of words and in a non-noisy situation. In order to reinforce the detection decision of this area, the method also uses the minimum rr(i) of the discrete detection function $FD_i(\tau)$, where the discrete detection function $FD_i(\tau)$ corresponds either to the discrete difference function $D_i(\tau)$ or to the discrete normalized difference function $DN_i(\tau)$. Therefore, the voice will be cut more quickly at the end of speech, thereby giving the system a better audio quality.

An object of the invention is also a computer program comprising code instructions able to control the execution of the steps of the voice detection method as defined hereinabove when executed by a processor.

A further object of the invention is a recording medium for recording data on which a computer program is stored as defined hereinabove.

Another object of the invention is the provision of a computer program as defined hereinabove over a telecommunication network for its download.

Other characteristics and advantages of the present invention will appear upon reading the detailed description hereinafter, of a not limiting example of implementation, with reference to the appended figures wherein.

Figure 1:
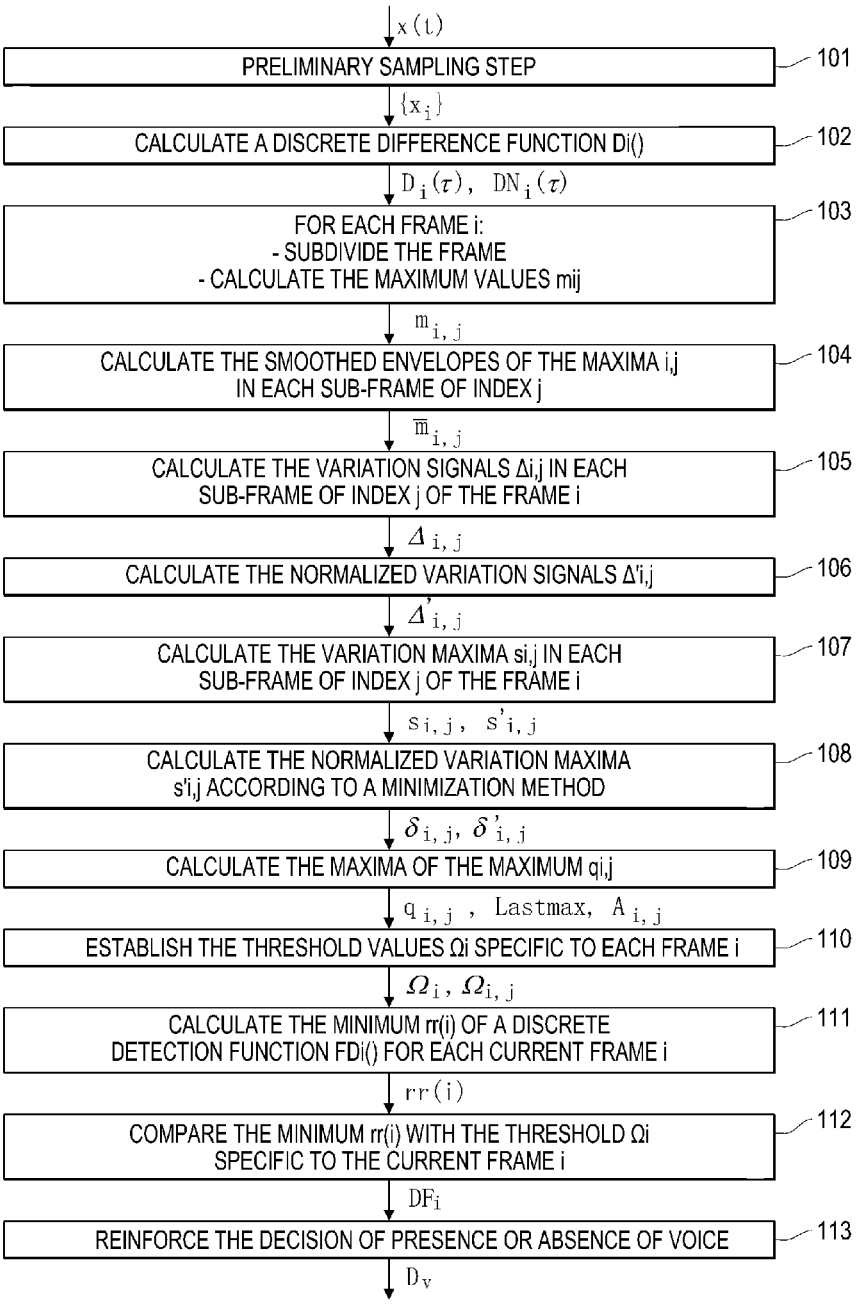
FIG. 1 is an overview diagram of the method in accordance with the invention.

The description of the voice detection method is made with reference to FIG. 1 which schematically illustrates the succession of the different steps required for detecting the presence of speech (or voice) signals in an noisy acoustic signal x(t) coming from a single microphone operating in a noisy environment.

The method begins with a preliminary sampling step 101 comprising a cutting of the acoustic signal x(t) into a discrete acoustic signal $\{x_i\}$ composed of a sequence of vectors associated with time frames i of length N, N corresponding to the number of sampling points, where each vector reflects the acoustic content of the associated frame i and is composed of N samples $x_{(i-1)N+1}, x_{(i-1)N+2} \ldots, x_{iN-1}, x_{iN}$, i being a positive integer:

By way of example, the noisy acoustic signal x(t) is divided into frames of 240 or 256 samples, which, at a sampling frequency $F_e$ of 8 kHz, corresponds to 30 or 32 milliseconds time frames.

The method continues with a step 102 for calculating a discrete difference function $D_i(\tau)$ relative to the frame i calculated as follows:

subdividing each frame i into k sub-frames of length H, with the following relationship:

$$K = \left\lfloor \frac{N - \max(\tau)}{H} \right\rfloor$$

where ⌊ ⌋ represents the operator of rounding to integer part, so that samples of the discrete acoustic signal $\{x_i\}$ in a sub-frame of index p of the frame i comprise the H following samples:

$$x_{(i-1)N+(p-1)H+1}, x_{(i-1)N+(p-1)H+2}, \ldots, X_{(i-1)N+pH},$$

p being a positive integer comprised between 1 and K; then for each sub-frame of index p, calculating the following difference ddp(τ):

$$dd_p(\tau) = \Sigma_{j=(i-1)N+(p-1)H+1}^{(i-1)N+pH} |x_j - x_{j+\tau}|,$$

calculating the discrete difference function $D_i(\tau)$ relative to the frame i as the sum of the difference functions $dd_p(\tau)$ of the sub-frames of index p of the frame i, namely:

$$D_i(\tau) = \Sigma_{p=1}^{k} ddp(\tau).$$

It is also possible that step 102 also comprise the calculation of a discrete normalized difference function dNi(τ) from the discrete difference function $D_i(\tau)$, as follows:

$$DNi(\tau) = 1 \text{ if } \tau = 0,$$

$$DNi(\tau) = \frac{Di(\tau)}{(1/\tau)\sum_{j=1}^{\tau} D_i(j)} \text{ if } \tau \neq 0.$$

The method continues with a step 103 wherein, for each frame i:

subdividing the frame i comprising N sampling points into T sub-frames of length L, where N is a multiple of T, so that the length L=N/T is integer, and so that the samples of the discrete acoustic signal $\{x_i\}$ in a sub-frame of index j of the frame i comprise the following L samples:

$$x_{(i-1)N+(j-1)L+1}, x_{(i-1)N+(j-1)L+2}, \ldots, x_{(i-1)N+jL},$$

j being a positive integer comprised between 1 and T;

b) calculating the maximum values $m_{i,j}$ of the discrete acoustic signal $\{x_i\}$ in each sub-frame of index j of the frame i, with:

$$m_{i,j} = \max\{x_{(i-1)N+(j-1)L+1}, x_{(i-1)N+(j-1)L+2}, \ldots, x_{(i-1)N+jL}\};$$

By way of example, each frame i of length 240 (let N=240) is subdivided into four sub-frames j of lengths 60 (namely T=4 and L=60).

Then, in a step 104, the smoothed envelopes of the maxima $\overline{m}_{i,j}$ in each sub-frame of index j of the frame i is calculated, defined by:

$$\overline{m}_{i,j} = \lambda \overline{m}_{i,j-1} + (1-\lambda) m_{i,j},$$

where λ is a predefined coefficient comprised between 0 and 1.

Then, in a step 105, the variation signals $\Delta_{i,j}$ in each sub-frame of index j of the frame i is calculated, defined by:

$$\Delta_{i,j} = m_{i,j} - \overline{m}_{i,j} = \lambda(m_{i,j} - \overline{m}_{i,j-1})$$

Then, in a step 106, the normalized variation signals $\Delta'_{i,j}$ are calculated, defined by:

$$\Delta'_{i,j} = \frac{\Delta_{i,j}}{\overline{m}_{i,j}} = \frac{m_{i,j} - \overline{m}_{i,j}}{\overline{m}_{i,j}}.$$

Then, in a step 107, the variation maxima $s_{i,j}$ in each sub-frame of index j of the frame i are calculated, where $s_{i,j}$ corresponds to the maximum of the variation signal $\Delta_{i,j}$ calculated on a sliding window of length Lm prior to said sub-frame j. During this step 106, the length Lm is variable according to whether the sub-frame j of the frame i corresponds to a period of silence or presence of speech with:

Lm=L0 if the sub-frame j of the frame i corresponds to a period of silence;

Lm=L1 if the sub-frame j of the frame i corresponds to a period of presence of speech;

with L1<L0. By way of example, L1=k1.L and L0=k0.L being, as a reminder, the length of the sub-frames of index j and k0, k1 being positive integers with k1<k0. Furthermore, the sliding window of length Lm is delayed by Mm frames of length N vis-à-vis said sub-frame j.

During this step 106, the normalized variation maxima $s'_{i,j}$ are also calculated in each sub-frame of index j of the frame i, where:

$$s'_{i,j} = \frac{s_{i,j}}{\overline{m}_{i,j}}.$$

It is conceivable to calculate the normalized variation maxima $s'_{i,j}$ according to a minimization method comprising the following iterative steps:

calculating $s'_{i,j}=\max\{s'_{i,j-1};\ \Delta'_{i-Mm,j}\}$ and $\tilde{s}'_{i,j}=\max\{s'_{i,j-1};\ \Delta'_{i-Mm,j}\}$ if rem(i, Lm)=0, where rem is the remainder operator of the integer division of two integers, then:

$$s'_{i,j}=\max\{\tilde{s}'_{i,j-1};\Delta'_{i-Mm,j}\},$$

$$\tilde{s}'_{i,j}=\Delta'_{i-Mm,j}$$

end if with $s'_{0,1}=0$ and $\tilde{s}'_{0,1}=0$.

Then, in a step 108, the variation differences $\delta'_{i,j}$ in each sub-frame of index j of the frame i, defined by:

$$\delta_{i,j}=\Delta_{i,j}-s_{i,j}.$$

In this same step 108, the normalized variation differences $\delta'_{i,j}$ in each sub-frame of index j of the frame i, defined by:

$$\delta'_{i,j} = \frac{\delta_{i,j}}{\overline{m}_{i,j}} = \frac{m_{i,j} - \overline{m}_{i,j} - s_{i,j}}{\overline{m}_{i,j}}.$$

Then, in a step 109, the maxima of the maximum $q_{i,j}$ in each sub-frame of index j of the frame i, where $q_{i,j}$ corresponds to the maximum of the maximum value $m_{i,j}$ calculated on a sliding window of a fixed length Lq prior to said sub-frame j, where the sliding window of length Lq is delayed by Mq frames of length N vis-à-vis said sub-frame j. Advantageously, Lq>L0, and mainly Lq=kq.L with kq being a positive integer and kq>k0. Furthermore, we have Mq>Mm.

During this step 109, it is conceivable to calculate the maxima of the maximum $q_{i,j}$ according to a minimization method comprising the following iterative steps:

calculating $q_{i,j}=\max\{q_{i,j-1};\ m_{i-Mq,j}\}$ and $\tilde{q}_{i,j}=\max\{q_{i,j-1};\ m_{i-Mq,j}\}$ if rem (i, Lq)=0, which is the remainder operator of the integer division of two integers, then:

$$q_{i,j}=\max\{\tilde{q}_{i,j-1};m_{i-Mq,j}\},$$

$$\tilde{q}_{i,j}=m_{i-Mm,j}$$

end if with $q_{0,1}=0$ and $\tilde{q}_{0,1}=0$.

Then, in a step 110, the threshold values $\Omega_i$ specific to each frame i are established among a plurality of fixed values Ωa, Ωb, Ωc, etc. More finely, the values of the sub-thresholds $\Omega_{i,j}$ specific to each sub-frame j of the frame i are established, the threshold $\Omega_i$ being cut into several sub-thresholds $\Omega_{i,j}$. By way of example, each threshold $\Omega_i$ or sub-threshold $\Omega_{i,j}$ takes a fixed value selected from six fixed values Ωa, Ωb, Ωc, Ωd, Ωe, Ωf, these fixed values being for example comprised between 0.05 and 1, and in particular between 0.1 and 0.7.

Each threshold $\Omega_i$ or sub-threshold $\Omega_{i,j}$ is set at a fixed value Ωa, Ωb, Ωc, Ωd, Ωe, Ωf by the implementation of two analyses:

first analysis: comparing the values of the pair $(\Delta'_{i,j}, \delta'_{i,j})$ in the sub-frame of index j of the frame i with several pairs of fixed thresholds;

second analysis: comparing the maxima of the maximum $q_{i,j}$ in the sub-frame of index j of the frame i with fixed thresholds.

Following these analyses, a procedure called decision procedure will give the final decision on the presence of the voice in the frame i. This decision procedure comprises the following sub-steps for each frame i:

for each sub-frame j of frame i, an index of decision $DEC_i(j)$ which holds either a state «1» of detection of a speech signal or a state «0» of non-detection of a speech signal, is established;

establishing a temporary decision VAD(i) based on the comparison of the indices of decision $DEC_i(j)$ with logical operators «OR», so that the temporary decision VAD(i) holds a state «1» of detection of a speech signal if at least one of said indices of decision $DEC_i(j)$ holds this state «1» of detection of a speech signal, in other words, we have the following relationship:

$$VAD(i)=DEC_i(1)+DEC_i(2)+\ldots+DEC_i(T),$$

wherein "+" is the operator «OR».

Thus, depending on the comparisons made during the first and second analyses, and depending on the state of the temporary decision VAD(i), the threshold $\Omega_i$ is set at one of the fixed values Ωa, Ωb, Ωc, Ωd, Ωe, Ωf and the final decision is deduced by comparing the minimum rr(i) with the threshold $\Omega_i$ set at one of its fixed values (see description hereinafter).

In many cases, the false detections (or tonches) arrive with a magnitude lower than that of the speech signal, the microphone being located near the mouth of the user. By taking this into account, it is possible to further eliminate the false detections by storing the threshold maximum value Lastmax deduced from the speech signal in the last period of activation of the «VAD» and by adding a condition in the method based on this threshold maximum value Lastmax.

Thus, in step 109 described hereinabove, there is added the storing of the threshold maximum value Lastmax which corresponds to the variable (or updated) value of a comparison threshold for the magnitude of the discrete acoustic signal $\{x_i\}$ below which it is considered that the acoustic signal does not comprise speech signal, this variable value being determined during the last frame of index k which precedes said frame i and in which the temporary decision VAD(k) held a state «1» of detection of a speech signal.

In this step 109, there is also stored an average maximum value $A_{i,j}$ which corresponds to the average maximum value of the discrete acoustic signal $\{x_i\}$ in the sub-frame j of the calculated frame i as follows:

$$A_{i,j}=\theta A_{i,j-1}+(1-\theta)a_{i,j}$$

where $a_{i,j}$ corresponds to the maximum of the discrete acoustic signal $\{x_i\}$ contained in the theoretical frame k formed by the sub-frame j of the frame i and by at least one or more successive sub-frame(s) which precede said sub-frame j; and θ is a predefined coefficient comprised between 0 and 1 with $\theta<\lambda$.

In this step 109, the threshold maximum value Lastmax is updated whenever the method has considered that a sub-frame p of a frame k contains a speech signal, by implementing the following procedure:

- detecting a speech signal in the sub-frame p of the frame k follows a non-speech period, and in this case Lastmax takes the updated value $[\alpha(A_{k,p}+\text{LastMax})]$, where α is a predefined coefficient comprised between 0 and 1, and for example comprised between 0.2 and 0.7;
- detecting a speech signal in the sub-frame p of the frame k follows a period of presence of speech, and in this case Lastmax takes the updated value $A_{k,p}$ if $A_{k,p}>\text{Lastmax}$.

Then, in step 110 described hereinabove, a condition based on the threshold maximum value Lastmax is added i order to set the threshold $\Omega_i$.

For each frame i, this condition is based on the comparison between:

- the threshold maximum value Lastmax, and
- the values $[\text{Kp}.A_{i,j}]$ and $[\text{Kp}.A_{i,j-1}]$, where Kp is a fixed weighting coefficient comprised between 1 and 2.

It is also conceivable to lower the threshold maximum value Lastmax after a given time-out period (for example set between few seconds and some tens of seconds) between the frame i and the last aforementioned frame of index k, in order to avoid the non-detection of the speech if the user/speaker significantly decreases the magnitude of his voice.

Then, in a step 111, there is calculated for each current frame i, the minimum rr(i) of a discrete detection function FDi(τ), where the discrete detection function FDi(τ) corresponds either to the discrete difference function Di(τ) or to the discrete normalized difference function DNi(τ).

Finally, in a last step 112, for each current frame i, this minimum rr(i) is compared with the threshold $\Omega_i$ specific to the frame i, in order to detect the presence or the absence of a speech signal (or voiced signal), with:

- if $rr(i)\leq\Omega_i$, then the frame i is considered as representative of a speech signal and the method provides an output signal $DF_i$ taking the value «1» (in other words, the final decision for the frame i is «presence of voice in the frame i»);
- if $rr(i)>\Omega_i$ then the frame i is considered as having no speech signal and the method provides an output signal $DF_i$ taking the value «0» (in other words, the final decision for the frame i is «absence of voice in the frame i»).

Figure 2:
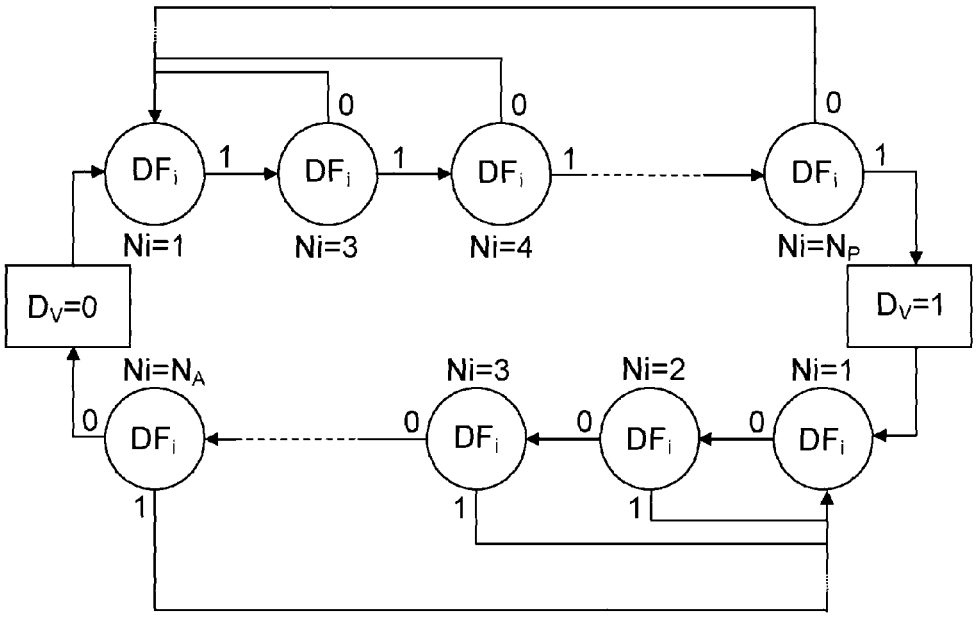
FIG. 2 is a schematic view of a limiting loop implemented by a decision blocking step called hangover type step.

With reference to FIGS. 1 and 2, it is possible to provide an improvement to the method, by introducing an additional decision blocking step 113 (or hangover step), to avoid the sound cuts in a sentence and during the pronunciation of words, this decision blocking step 113 aiming to reinforce the decision of presence/absence of voice by the implementation of the two following steps:

- switching from a state of non-detection of a speech signal to a state of detection of a speech signal after having detected the presence of a speech signal on $N_P$ successive time frames i;
- switching from a state of detection of a speech signal to a state of non-detection of a speech signal after having detected no presence of a voiced signal on $N_A$ successive time frames i.

Thus, this blocking step 113 allows outputting a decision signal of the detection of the voice $D_V$ which takes the value «1» corresponding to a decision of the detection of the voice and the value «0» corresponding to a decision of the non-detection of the voice, where:

- the decision signal of the detection of the voice $D_V$ switches from a state «1» to a state «0» if and only if the output signal $DF_i$ takes the value «0» on $N_A$ successive time frames i; and
- the decision signal of the detection of the voice $D_V$ switches from a state «0» to a state «1» if and only if the output signal $DF_i$ takes the value «1» on $N_P$ successive time frames i.

Referring to FIG. 2, if we assume that we start from a state «$D_V$=1», we switch to a state «$D_V$=0» if the output signal $DF_i$ takes the value «0» on $N_A$ successive frames, otherwise the state remains at «$D_V$=1» ($N_i$ representing the number of the frame at the beginning of the series). Similarly, if we assume that we start from a state «$D_V$=0», we switch to a state «$D_V$=1» if the output signal $DF_i$ takes the value «1» on $N_P$ successive frames, otherwise the state remains at «$D_V$=0».

The final decision applies to the first H samples of the processed frame. Preferably, $N_A$ is greater than $N_P$, with for example $N_A$=100 and $N_P$=3, because it is better to risk detecting silence rather than to cut a conversation.

Figure 3:
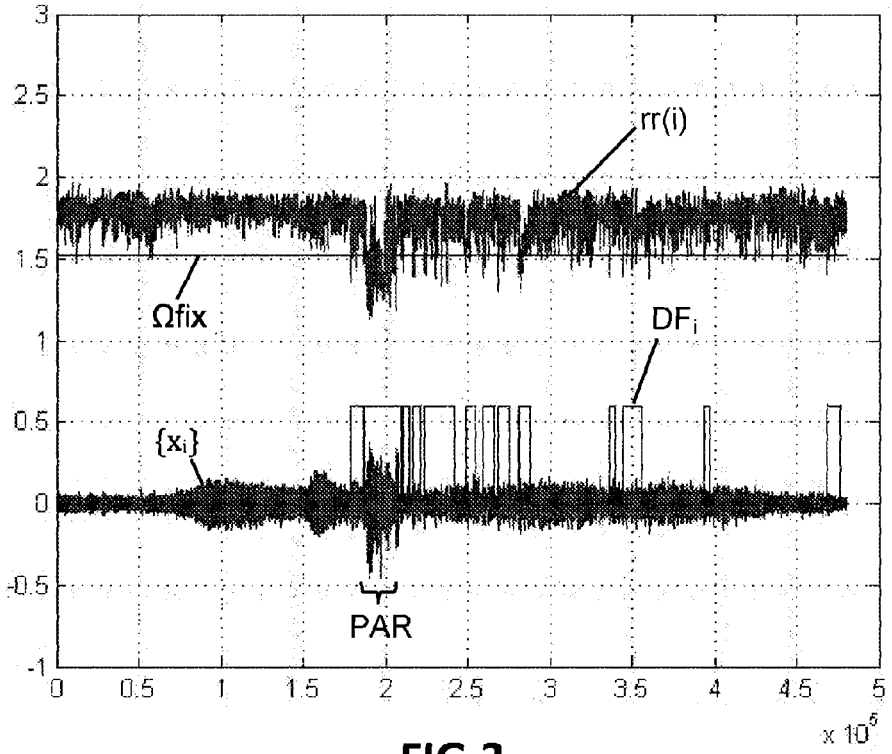
FIG. 3 illustrates the result of a voice detection method using a fixed threshold with, at the top, a representation of the curve of the minimum rr(i) of the detection function and of the fixed threshold line Ωfix and, at the bottom, a representation of the discrete acoustic signal $\{x_i\}$ and of the output signal $DF_i$.
Figure 4:
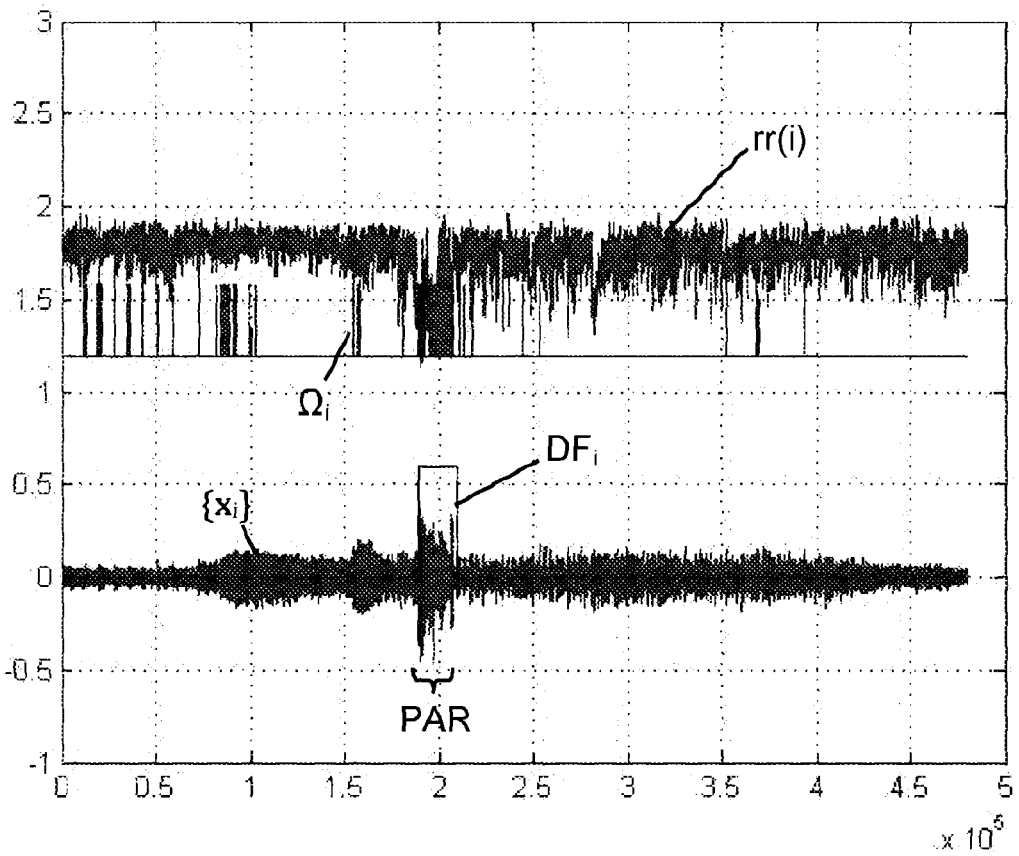
FIG. 4 illustrates the result of a voice detection method in accordance with the invention using an adaptive threshold with, at the top, a representation of the curve of the minimum rr(i) of the detection function and of the adaptive threshold line $\Omega_i$ and, at the bottom, a representation of the discrete acoustic signal $\{x_i\}$ and of the output signal $DF_i$.

The rest of the description focuses on two voice detection results obtained with a conventional method using a fixed threshold (FIG. 3) and with the method in accordance with the invention using an adaptive threshold (FIG. 4).

In FIGS. 3 and 4 (at the bottom), it is noted that the two methods work on the same discrete acoustic signal $\{x_i\}$, with the magnitude on the ordinates and the samples on the abscissae. This discrete acoustic signal $\{x_i\}$ has a single area of presence of speech «PAR», and many areas of presence of unwanted noises, such as music, drums, crowd shouts and whistles. This discrete acoustic signal $\{x_i\}$ reflects an environment representative of a communication between people (such as referees) within a stadium or a gymnasium where the noise is relatively very strong in level and is highly non-stationary.

In FIGS. 3 and 4 (at the top), there is noted that the two methods exploit the same function rr(i) corresponding, by way of reminder, to the minimum of the selected discrete detection function FDi(τ).

In FIG. 3 (at the top), the minimum function rr(i) is compared to a fixed fixed threshold $\Omega_{fix}$ optimally selected in order to ensure the detection of the voice. In FIG. 3 (at the bottom), there is noted the shape of the output signal $DF_i$ which holds a state «1» if $rr(i)\leq\Omega fix$ and a state «0» if $rr(i)>\Omega fix$.

In FIG. 4 (at the top), the minimum function rr(i) is compared with an adaptive threshold $\Omega_i$ calculated according to the steps described hereinabove with reference to FIG. 1. In FIG. 4 (at the bottom), there is noted the shape of the output signal $DF_i$ which holds a state «1» if $rr(i)\leq\Omega_i$ and a state «0» if $rr(i)>\Omega_i$.

It is noted in FIG. 3 that the method in accordance with the invention allows a detection of the voice in the area of presence of speech «PAR» with the output signal $DF_i$ which holds a state «1», and that this same output signal $DF_i$ holds several times a state «1» in the other areas where the speech is yet absent, which corresponds with unwanted false detections with the conventional method.

However, it is noted in FIG. 4 that the method in accordance with the invention allows an optimum detection of the voice in the area of presence of speech «PAR» with the output signal $DF_i$ which holds a state «1», and that this same output signal $DF_i$ holds a state «0» in the other areas where the speech is absent. Thus, the method in accordance with the invention ensures a detection of the voice with a strong reduction of the number of false detections.

Of course, the example of implementation mentioned hereinabove has no limiting character and other improvements and details may be made to the method according to the invention, without departing from the scope of the invention where other calculation algorithms of the detection function FD(τ) may for example be used.

The invention claimed is:

1. A voice detection and output method for detecting the presence of acoustic speech in acoustic waves produced in an environment containing acoustic noise, and transmitting electrical speech signals outputted from a microphone disposed in the environment for communicating the content of the acoustic speech when the presence of acoustic speech in the environment is detected from electrical audio signals x(t) outputted from the microphone, comprising the steps of:

receiving an output from the microphone of the electrical audio signals produced by transforming the acoustic waves in the environment into electrical audio signals comprising at least one of the electrical speech signals and electrical noise signals;

the electrical speech signals representing the acoustic speech produced in the noisy environment in which the microphone is disposed, and the electrical noise signals representing the acoustic noise produced in the noisy environment in which the microphone is disposed;

transmitting the electrical speech signals by an audio communication system to communicate the content of the corresponding acoustic speech when the presence of the electrical speech signals is detected in the electrical audio signals outputted from the microphone; and outputting an output signal representing the result of processing the electrical audio signals output from the microphone, wherein the output signal signifies the presence of acoustic speech in the acoustic waves or the absence of acoustic speech in the acoustic waves detected by the microphone, the presence of electrical speech signals in the electrical audio signals is detected and the electrical speech signals are transmitted when the output signal signifies the presence of acoustic speech in the acoustic wave, the processing comprising the following successive steps:

a preliminary sampling step comprising a cutting of the audio signal x(t) into a discrete acoustic signal $\{x_i\}$ composed of a sequence of vectors associated with time frames i of length N, N corresponding to the number of sampling points, where each vector reflects the acoustic content of the associated frame i and is composed of the N samples $x_{(i-1)N+1}$, $x_{(i-1)N+2}$, . . . , $x_{iN-1}$, $x_{iN}$, i being a positive integer;

a step of calculating a detection function FD(τ) based on the calculation of a difference function D(τ) varying in accordance with a shift τ on an integration window of length W starting at the time t0, with:

$$D(\tau)=\Sigma_{n=t0}^{t0+w-1}|x(n)-x(n+\tau)| \text{ where } 0\leq\tau\leq\max(\tau);$$

wherein this step of calculating a detection function FD(τ) consists in calculating a discrete detection function $FD_i(\tau)$associated with the frames i;

a step of adapting a threshold $\Omega_i$ in said current interval, in accordance with values calculated from the audio signal x(t) established in said current interval, wherein this step of adapting the threshold $\Omega_i$ consists, for each frame i, in adapting the threshold $\Omega_i$ specific to the frame i depending on reference values calculated from the values of the samples of the discrete acoustic signal $\{x_i\}$ in said frame i;

a step of searching for a minimum of the detection function FD(τ) and comparing this minimum with the threshold $\Omega_i$, for τ varying in a determined interval of time called current interval in order to detect the presence or not of a fundamental frequency $F_0$ characteristic of a speech signal within said current interval, where this step of searching for a minimum of the detection function FD(τ) and comparing this minimum with the threshold $\Omega_i$ is carried out by searching, on each frame i, for a minimum rr(i) of the discrete detection function $FD_i(\tau)$ and by comparing this minimum rr(i) with the threshold $\Omega_i$ specific to the frame i;

and wherein a step of adapting the threshold $\Omega_i$ for each frame i includes the following steps:

a)—subdividing the frame i comprising N sampling points into T sub-frames of length L, where N is a multiple of T so that the length L=N/T is an integer, and so that the samples of the discrete acoustic signal $\{x_i\}$ in a sub-frame of index j of the frame i comprise the following L samples:

$$x_{(i-1)N+(j-1)L+1}, x_{(i-1)N+(j-1)L+2}, \ldots, x_{(i-1)N+(j-1)},$$

j being a positive integer comprised between 1 and T;

b)—calculating maximum values $m_{i,j}$ of the discrete acoustic signal $\{x_i\}$ in each sub-frame of index j of the frame i, with:

$$m_{i,j}=\max\{x_{(i-1)N+(j-1)L+1}, x_{(i-1)N+(j-1)L+2}, \ldots, x_{(i-1)N+(j-1)}\};$$

c)—calculating at least one reference value $Ref_{i,j}$, $MRef_{1,j}$ specific to the sub-frame j of the frame i, the or each reference value $Ref_{i,j}$, $MRef_{i,j}$ per sub-frame j being calculated from the maximum value $m_{i,j}$ in the sub-frame j of the frame i;

d)—establishing the value of the threshold $\Omega_i$ specific to the frame i depending on all reference values $Ref_{i,j}$, $MRef_{1,j}$ calculated in the sub-frames j of the frame i to detect the presence or absence of electrical speech signals.

2. The detection method according to claim 1, wherein the detection function FD(τ) corresponds to the difference function D(τ).

3. The detection method according to claim 1, wherein the detection function FD(τ) corresponds to the normalized difference function DN(τ) calculated from the difference function D(τ) as follows:

$$DN(\tau) = 1 \text{ if } \tau = 0,$$

$$DN(\tau) = \frac{D(\tau)}{(1/\tau)\sum_{j=1}^{\tau} D(j)} \text{ if } \tau \neq 0;$$

where the calculation of the normalized difference function DN(τ) consists in calculating a discrete normalized difference function $DN_i(\tau)$ associated with the frames i, where:

$$DN_i(\tau) = 1 \text{ if } \tau = 0,$$

$$DN_i(\tau) = \frac{D_i(\tau)}{(1/\tau)\sum_{j=1}^{\tau} D_i(j)} \text{ if } \tau \neq 0.$$

4. The method according to claim 1, wherein the discrete difference function $D_i(\tau)$ relative to the frame i is calculated as follows:

subdividing the frame i into K sub-frames of length H, with $$K = \left\lfloor \frac{N - \max(\tau)}{H} \right\rfloor$$

where $\lfloor\ \rfloor$ represents the operator of rounding to integer part, so that the samples of the discrete acoustic signal $\{x_i\}$ in a sub-frame of index p of the frame i comprises the H samples:

$$x_{(i-1)N+(p-1)H+1}, x_{(i-1)N+(p-1)H+2}, x_{(i-1)N+pH},$$

p being a positive integer comprised between 1 and K;

for each sub-frame of index p, the following difference function $dd_p(\tau)$ is calculated:

$$dd_p(\tau)=\Sigma_{j=(i-1)N+(p-1)H+1}^{(i-1)N+pH}|x_j-x_{j+\tau}|,$$

calculating the discrete difference function $D_i(\tau)$ relative to the frame i as the sum of the difference functions $dd_p(\tau)$ of the sub-frames of index p of the frame i, namely:

$$D_i(\tau)=\Sigma_{p=1}^{K} dd_p(\tau).$$

5. The method according to claim 1, wherein, during step c), the following sub-steps are carried out on each frame i:

c1)—calculating smoothed envelopes of a maxima $\overline{m}_{i,j}$ in each sub-frame of index j of the frame i, with:

$$\overline{m}_{i,j}=\lambda\overline{m}_{i,j-1}+(1-\lambda)m_{i,j},$$

where $\lambda$ is a predefined coefficient comprised between 0 and 1;

c2)—calculating variation signals $\Delta_{i,j}$ in each sub-frame of index j of the frame i, with:

$$\Delta_{i,j}=m_{i,j}-\overline{m}_{i,j}=\lambda(m_{i,j}-\overline{m}_{i,j-1});$$

and where at least one reference value called main reference value $Ref_{i,j}$ per sub-frame j is calculated from the variation signal $\Delta_{i,j}$ in the sub-frame j of the frame i.

6. The method according to claim 5, wherein, during step c) and as a result of the sub-step c2), the following sub-steps are carried out on each frame i:

c3)—calculating variation maxima $s_{i,j}$ in each sub-frame of index j of the frame i, where $s_{i,j}$ corresponds to the maximum of the variation signal $\Delta_{i,j}$ calculated on a sliding window of length Lm prior to said sub-frame j, said length Lm being variable according to whether the sub-frame j of the frame i corresponds to a period of silence or of presence of speech;

c4)—calculating variation differences $\delta_{i,j}$ in each sub-frame of index j of the frame i, with:

$$\delta_{i,j}=\Delta_{i,j}-s_{i,j};$$

and where, for each sub-frame j of the frame i, two main reference values $Ref_{i,j}$ are calculated respectively from the variation signal $\Delta_{i,j}$ and the variation difference $\delta_{i,j}$.

7. The method according to claim 6, wherein, during step c) and as a result of the sub-step c4), a sub-step c5) of calculating normalized variation signals $\Delta'_{i,j}$ and normalized variation differences $\delta'_{i,j}$ in each sub-frame of index i of the frame i, as follows:

$$\Delta'_{i,j} = \frac{\Delta_{i,j}}{\overline{m}_{i,j}} = \frac{m_{i,j} - \overline{m}_{i,j}}{\overline{m}_{i,j}};$$

$$\delta'_{i,j} = \frac{\delta_{i,j}}{\overline{m}_{i,j}} = \frac{m_{i,j} - \overline{m}_{i,j} - s_{i,j}}{\overline{m}_{i,j}};$$

and where, for each sub-frame j of a frame i, the normalized variation signal $\Delta'_{i,j}$ and the normalized variation difference $\delta'_{i,j}$, constitute each a main reference value $Ref_{i,j}$ so that, during step d), the value of the threshold $\Omega_i$ specific to the frame i is established depending on ache pair $(\Delta'_{i,j}, \delta'_{i,j})$ of the normalized variation signals $\Delta'_{i,j}$ and the normalized variation differences $\delta'_{i,j}$ in the sub-frames j of the frame i.

8. The method according to claim 7, wherein, during step d), the value of the threshold $\Omega_i$ specific to the frame i is established by partitioning a space defined by the value of the pair $(\Delta'_{i,j}, \delta'_{i,j})$, and by examining the value of the pair $(\Delta'_{i,j}, \delta'_{i,j})$ on one or more successive sub-frame(s) according to a value area of the pair $(\Delta'_{i,j}, \delta'_{i,j})$.

9. The method according to claim 6, wherein, wherein, during the sub-step c3), the length Lm of the sliding window meets the following equations:

Lm=L0 if the sub-frame j of the frame i corresponds to a period of silence;

Lm=L1 if the sub-frame j of the frame i corresponds to a period of presence of speech;

with L1<L0.

10. The method according to claim 6, wherein, when the sub-step c3), for each calculation of the variation maximum $s_{i,j}$ in the sub-frame j of the frame i, the sliding window of length Lm is delayed by Mm frames of length N vis-à-vis said sub-frame j.

11. The method according to claim 7 wherein, during the sub-step c3), normalized variation maxima $s'_{i,j}$ are also calculated in each sub-frame of index j of the frame i, wherein $s'_{i,j}$ corresponds to the maximum of the normalized variation signal $\Delta'_{i,j}$ calculated on a sliding window of length Lm prior to said sub-frame j, where:

$$s'_{i,j} = \frac{s_{i,j}}{\overline{m}_{i,j}};$$

and wherein each normalized variation maximum $s'_{i,j}$ is calculated according to a minimization method comprising the following iterative steps:

calculating $s'_{i,j}=\max\{s'_{i,j-1};\ \Delta'_{i-Mm,j}\}$ and $\tilde{s}'_{i,j}=\max\{s'_{i,j-1};\ \Delta'_{i-Mm,j}\}$;

if rem(i, Lm)=0, where rem is an operator remainder of the integer division of two integers, then:

$$s'_{i,j}=\max\{s'_{i,j-1};\Delta'_{i-Mm,j}\}$$

$$\tilde{s}'_{i,j}=\Delta'_{i-Mm,j};$$

with $s'_{0,1}=0$ and $\tilde{s}'_{0,1}=0$;

and wherein, during step c4), the normalized variation differences $\delta'_{i,j}$ in each sub-frame of index j of the frame i are calculated as follows:

$$\delta'_{i,j}=\Delta'_{i,j}-s'_{i,j}.$$

12. The method according to claim 5, wherein, during step c), there is carried out a sub-step c6) wherein calculating maxima of maximum $q_{i,j}$ in each sub-frame of index j of the frame i, wherein $q_{i,j}$ *corresponds* to the maximum of the maximum value $m_{i,j}$ calculated on a sliding window of fixed length Lq prior to said sub-frame j, where the sliding window of length Lq is delayed by Mq frames of length of N vis-à-vis said sub-frame j, and where another reference value called secondary reference value $MRef_{i,j}$ per sub-frame j corresponds to said maximum of maximum $q_{i,j}$ in the sub-frame j of the frame i.

13. The method according to claim 5, wherein, during step d), the threshold $\Omega_i$ specific to the frame i is divided into several sub-thresholds $\Omega_{i,j}$ specific to each sub-frame j of the frame i, and the value of each sub-threshold $\Omega_{i,j}$ is at least established depending on the reference value(s) $Ref_{i,j}$, $MRef_{i,j}$ calculated in the sub-frame j of the corresponding frame i.

14. The method according to claim 7, wherein, during step d), the value of each threshold $\Omega_{i,j}$ specific to the sub-frame j of the frame i is established by comparing the values of the pair ($\Delta'_{i,j}$, $\delta'_{i,j}$) with several pairs of fixed thresholds, the value of each threshold $\Omega_{i,j}$ being selected from several fixed values depending on comparisons of the pairs ($\Delta'_{i,j}$, $\delta'_{i,j}$) with said pairs of fixed thresholds.

15. The method according to claim 5, wherein, during step d), a procedure called decision procedure comprising the following sub-steps, for each frame i, is carried out:

for each sub-frame j of the frame i, establishing a decision index $DEC_1(j)$ which holds either a state «1» of detection of a speech signal or a state «0» of non-detection of a speech signal;

establishing a temporary decision VAD(i) based on the comparison of the indices of decision $DEC_1(j)$ with logical operators «OR», so that the temporary decision VAD(i) holds a state «1» of detection of a speech signal if at least one of said indices of decision $DEC_i(j)$ holds this state «1» of detection of a speech signal.

16. The method according to claim 13, wherein, during the decision procedure, there are carried out the following sub-steps for each frame i:

storing a threshold maximum value Lastmax which corresponds to the variable value of a comparison threshold for the magnitude of the discrete acoustic signal $\{x_i\}$, below which it is considered that the acoustic signal does not comprise speech signal, this variable value being determined during the last frame of index k which precedes said frame i and in which the temporary decision VAD(k) held a state «1» of detection of a speech signal;

storing an average maximum value $A_{i,j}$ which corresponds to the average maximum value of the discrete acoustic signal $\{x_i\}$ in the sub-frame j of the calculated frame i as follows:

$$A_{i,j}=\theta A_{i,j-1}+(1-\theta)a_{i,j}$$

where $a_w$ corresponds to the maximum of the discrete acoustic signal $\{x_i\}$ contained in a frame formed by the sub-frame j of the frame i and by at least one or more successive sub-frame(s) which precede said sub-frame j; and $\theta$ is a predefined coefficient comprised between 0 and 1 with $\theta<\lambda$;

establishing the value of each sub-threshold $\Omega_{i,j}$ depending on the comparison between said threshold maximum value Lastmax and average maximum values $A_{i,j}$ and considered on two successive sub-frames j and j−1.

17. The method according to claim 16, wherein, during the decision procedure, the threshold maximum value Lastmax is updated whenever the method has considered that a sub-frame p of a frame k contains a speech signal, by implementing the following procedure:

$$k,p+\text{LastMax})],$$

where $\alpha$ is a predefined coefficient comprised between 0 and 1;

detecting a speech signal in the sub-frame p if the frame k follows a period of presence of speech, and in this case Lastmax takes the updated value $A_{k,p}$ if $A_{k,p}>\text{Lastmax}$.

18. The method according to claim 16, wherein, the value of threshold $\Omega_i$ is established depending on said maximum value Lastmax based on the comparison between:

the maximum threshold value Lastmax; and the values $[Kp.A_{i,j}]$ and $[Kp.A_{i,j-1}]$, where Kp is a fixed weighting coefficient comprised between 1 and 2.

19. The method according to claim 1, further including a phase called blocking phase comprising a switching step from a state of non-detection of a speech signal to a state of detection of a speech signal after having detected the presence of a speech signal on Np successive time frames i.

20. The method according to claim 1, further comprising a phase called blocking phase comprising a switching step from a detection state of a speech signal to a state of non-detection of a speech signal after having detected no presence of a speech signal on $N_A$ successive time frames i.

21. The method according to claim 19, further including a step of interrupting the blocking phase in decision areas occurring at the end of words and in a non-noisy situation, said decision areas being detected by analyzing the minimum rr(i) of the discrete detection function $FD_i(\tau)$.

22. A non-transitory computer readable data recording medium on which is stored a computer program instructing a computer to perform the method according to claim 1.

* * * * *